United States Patent [19]

Gilbrech

[11] 4,060,018

[45] Nov. 29, 1977

[54] BANJO DRUMHEAD

[76] Inventor: Donald A. Gilbrech, 1302 Beechwood Ave., Fayetteville, Ark. 72701

[21] Appl. No.: 660,700

[22] Filed: Feb. 23, 1976

[51] Int. Cl.[2] ..... G10D 1/10

[52] U.S. Cl. ..... 84/269; 84/411 R

[58] Field of Search ..... 84/269, 411 R

[56] References Cited

U.S. PATENT DOCUMENTS

| | | | |
|---|---|---|---|
| 451,782 | 5/1891 | Smith et al. | 84/269 |
| 1,080,440 | 12/1913 | Habermann | 84/269 |
| 1,378,212 | 5/1921 | Bolander | 84/269 |
| 1,437,379 | 11/1922 | Kirk | 84/269 |
| 1,678,456 | 7/1928 | Altermath | 84/269 |

*Primary Examiner*—Stephen J. Tomsky
*Attorney, Agent, or Firm*—Head, Johnson & Chafin

[57] ABSTRACT

An improved banjo drumhead having a circumferential body rim and a separate tone ring which receives the head membrane stretched over it, the tone ring being supported relative to the body rim by a number of cantilevered support columns extending from the body rim, the head membrane being stretched over the tone ring and affixed to the body rim so that the only mechanical connection between the tone ring and the body rim is the plurality of cantilevered support columns permitting the tone ring to achieve independent vibrational movement relative to the body rim.

9 Claims, 4 Drawing Figures

BANJO DRUMHEAD

BACKGROUND AND OBJECTS OF THE INVENTION

The banjo is a well known and popular musical instrument and has the distinction of being one of the few musical instruments developed in America. The popularity of the banjo is attributed to its unique sound compared to the guitar, mandolin and other string instruments. The banjo consists basically of a drumhead having a thin flexible membrane stretched over it and a neck which is usually longer and narrower than on other string instruments extending from the drumhead. Strings are attached to a tailpiece affixed to the drumhead and extend across the drumhead and parallel to the neck and are attached at the upper end of the neck using tuning pins by which the stress on each string is independently adjustable. A bridge is positioned between the strings and the head membrane to convey the vibration of the strings to the membrane, thereby achieving the tonal qualities of the instrument.

The present invention is directed towards an arrangement of supporting the tone ring relative to the drumhead in such a way as to permit maximum vibrational independence of the tone ring while at the same time securely retaining it relative to the drumhead.

It is therefore an object of this invention to provide an improved banjo drumhead.

More particularly, an object of this invention is to provide an improved arrangement for supporting a tone ring to a banjo drumhead permitting improved vibrational independence of the tone ring relative to the banjo drumhead.

These general objects as well as other and more specific objects of the invention will be fulfilled in the following description and claims, taken in conjunction with the attached drawings.

DESCRIPTION OF VIEWS

SUMMARY OF THE INVENTION

Figure 1:
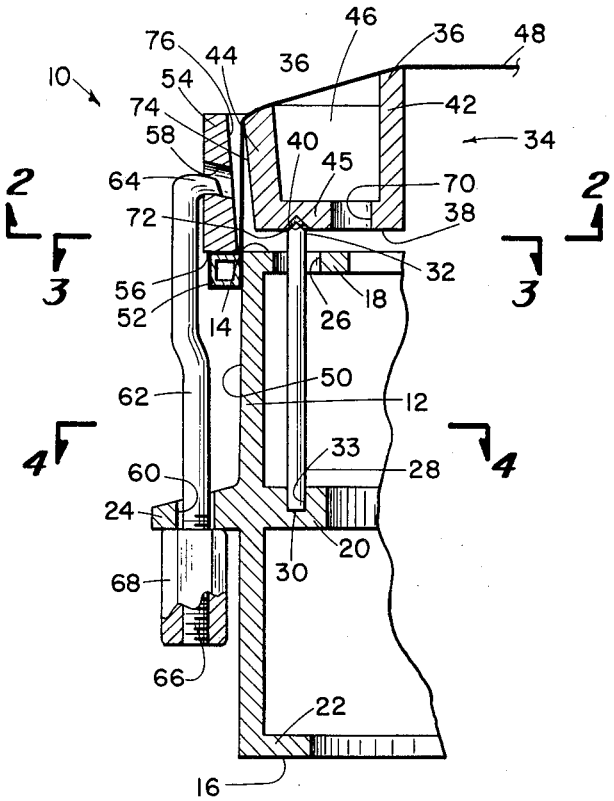
FIG. 1 is a cross-sectional view of a portion of a drumhead including improved means of supporting the tone ring according to this invention.
Figure 3:
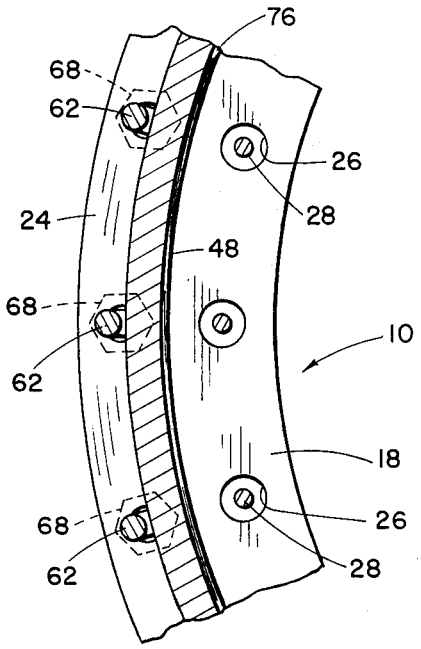
FIG. 3 is a cross-sectional view taken along the line 3—3 of FIG. 1.
Figure 2:
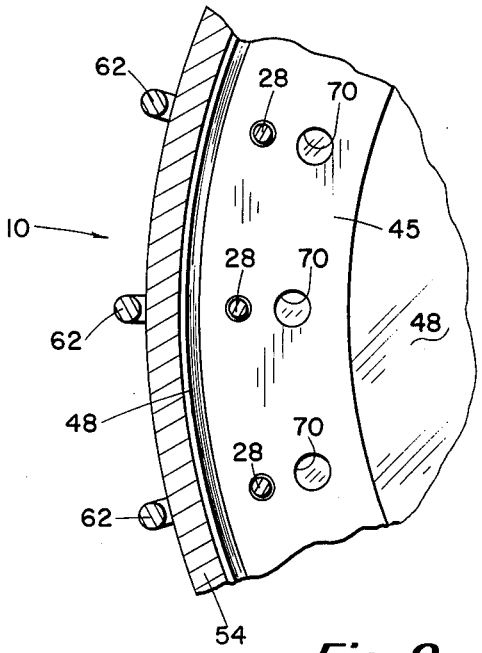
FIG. 2 is a fragmentary cross-sectional view taken along the line 2—2 of FIG. 1 showing a portion of the banjo drumhead.
Figure 4:
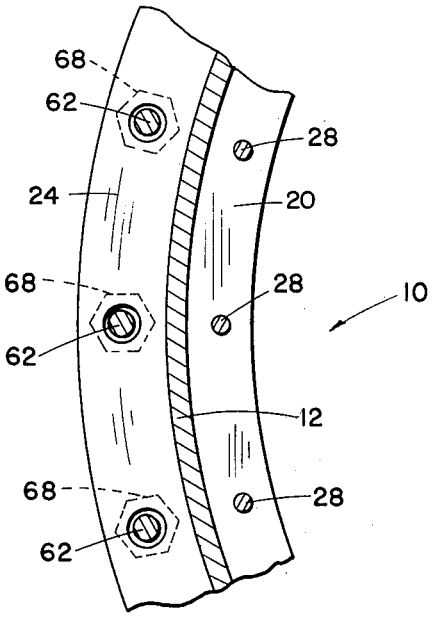
FIG. 4 is another cross-sectional view taken along the line 4—4 of FIG. 1.

An improved banjo drumhead is disposed including a circumferential body rim, a circumferential tone ring of a diameter substantially equal to the body rim, the tone ring being adapted to have the head membrane stretched over it and secured to the rim body, the invention providing improved means of supporting the tone ring to the drumhead body rim providing improved vibrational independence of the tone ring relative to the body rim, the means of supporting the tone ring including a plurality of cantilevered columns each secured at its lower end to the body rim and extending upwardly and in planes parallel to the axis of the body rim to engage the lower surface of the tone ring. The banjo drumhead includes means of adjustably supporting the head membrane to the outer periphery of the body rim, the head membrane retaining the tone ring in contact with the support columns.

DETAILED DESCRIPTION

Referring to the drawings the improved banjo drumhead of this invention is indicated generally by the numeral 10. The complete banjo musical instruments include a circular drumhead having a head membrane stretched over it, a portion of which is shown in the drawings, an elongated neck, a tailpiece by which strings are attached to the drumhead, and strings stretched from the tailpiece to tuning pins affixed to the upper end of the neck and a bridge positioned between the strings and the head membrane. The neck, tuning pins, strings, bridge and tailpiece of the instrument are not shown since they form no part of the invention but instead, the invention is directed exclusively to the construction of the drumhead.

The drumhead 10 is formed by a circumferential body rim 12 having an upper end 14 and a lower end 16. The body rim 12 includes an integral inwardly extending upper flange 18, an integral inwardly extending intermediate flange 20, an integral inwardly extending bottom flange 22 and an outwardly extending flange 24. The flanges 18, 20, 22 and 24 are all in planes parallel the plane of the body rim 12 itself. Upper flange 18 has spaced apart openings 26.

A plurality of support columns 28 are employed, each column having a lower end 30 and an upper end 32. The lower end 30 of each support column 28 is received in an opening 33 in intermediate flange 20. Each support column 28 extends parallel the axis of body rim 12 and the upper portion is received in an opening 26 in upper flange 18, the upper end 28 being above the body rim upper end 14.

Positioned above the upper end 14 of body rim is a tone ring generally indicated by 34. The tone ring is circumferential and of outside diameter substantially equal the outside diameter of body rim 12 and is supported adjacent the upper end 14 of the body and parallel to it. Tone ring 34 has an upper surface 36 and a lower surface 38. Formed in the lower surface 38 are a plurality of spaced apart indentations 40, there being one indentation 40 for each support column 28. Each indentation is preferably circular with a V-shaped cross-sectional configuration, as shown, to receive the pointed upper end 32 of a support column.

The tone ring 34 as illustrated is formed of a U-shaped cross-section having an inner circumferential wall 42 and an outer circumferential wall 44 providing a valley space 46 therebetween. The upper surface 36 of the tone ring in this arrangement is the upper surface of walls 42 and 44.

Stretched over the tone ring upper surface 36 is a head membrane 48. The outer periphery of the head member 48 extends down and around the outer circumferential surface 50 of the rim body. The outer periphery of the head membrane 48 is secured to a membrane retainer 52.

A clamp ring 54 is positioned around the tone ring 34 and is slidably received on the outer circumferential surface 50 of the rim body. The clamp ring lower surface 56 engages the membrane retainer 52. Spaced openings 58 are formed in the clamp ring and for each opening 58 there is an opening 60 in outwardly extending flange 24. A hook 62 having a bent upper end 64 and a threaded lower end 66 is used to retain the clamp ring 54 in position and to apply tension to the head membrane 48. The bent upper end 64 of a hook is received in each opening 58 in the clamp ring. The lower portion of a hook 62 is received in each opening 60 in the outwardly extending flange. A nut 68 secured on the threaded portion 66 of each hook 62 is used to adjust tension on the clamp ring 54 and thereby the tension of the head membrane 48.

To vary tonal qualities, holes 70 may be formed on the bottom wall 45 of the tone ring 34.

To further vibrationally isolate the tone ring 34 from the body rim 12 a dampening pad 72 may be positioned between the upper end 32 of each support column and the indentation 40 in the tone ring. The dampening pads 72 may be formed of nometallic material such as plastic, felt or any similar material having low sound transmitting qualities.

The tone ring has an outer circumferential surface 74 which is substantially equal in diameter to the rim body 12 surface 50. The surface 74 is tapered inwardly towards the tone ring bottom 38 so that the diameter of the tone ring at the bottom 38 is less than at the top 36. Clamp ring 54 has an inner circumferential surface 76 which is tapered in the direction opposite that of tone ring outer surface 74 so that the surfaces 74 and 76 are spaced apart and generally parallel to each other. The head membrane 48 extends within the space between the two tapered surfaces. This arrangement permits the diameter of the upper end of the outer circumferential surface 74 of the tone ring to be substantially equal to that of the outer diameter 50 of the rim body 12 but in a way so that the tone ring does not come into contact with the clamp ring 54.

It can be seen that the banjo drumhead described fulfills the objectives of the invention initially set forth. The tone ring is supported securely to the rim body 12 but in a way providing for maximum vibrational independence of the tone ring and rim body. The spaced apart elongated cantilevered support columns 28 hold the tone ring secured in spaced relationship relative to the rim body but yet permit a high degree of relative movement of the two parts. The rim body 12 is the superstructure of the banjo instrument and must be strongly constructed so as to support the neck which extends from it and the tension applied by the string. Since a certain degree of mass material is required to achieve the structural strength necessary, improved tonal qualities of the banjo instrument is attained when as much vibrational independence as possible is provided for the tone ring, which isthe result achieved by the present invention.

While the invention has been described with a certain degree of particularity it is manifest that many changes may be made in the details of construction and the arrangement of components without departing from the spirt and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An improved banjo drumhead comprising:

a circumferential body rim having an upper and lower end;

a plurality of spaced apart elongated cantilevered support columns each affixed at the lower end to said body rim at a point on said body rim below said upper end, and extending above and being spaced from said upper end, each support column being in a plane parallel to the rim axis;

a circumferential tone ring of diameter substantially equal to said body rim, the tone ring having an upper and a lower surface, the lower surface having means engaging the upper end of said support columns whereby said tone ring is supported adjacent to and spaced from said body rim in a plane parallel and coaxial with said body rim upper end, the upper surface of said tone ring being configured to receive a head membrane;

a circular head membrane stretched over said tone ring upper surface; and means securing the circumferential periphery of said head membrane to said body rim, said cantilevered support columns permitting vibrational movement of said tone ring relative to said body rim.

2. An improved banjo drumhead according to claim 1 wherein said body rim includes an inwardly projecting circumferential intermediate flange spaced between the body rim upper and lower ends, the lower end of each of said support columns being affixed to said intermediate flange.

3. An improved banjo drumhead according to claim 1 wherein said body rim includes an inwardly projecting circumferential upper flange adjacent the rim upper end, the upper flange having spaced openings therein the axis of each being parallel the rim, the diameter of each opening being greater than the diameter of said support columns and an inwardly projecting circumferential intermediate flange spaced between the body rim upper and lower ends, the lower end of each of said support columns being affixed to said intermediate flange and each support column being received in said opening in said upper flange, the lower end of said tone ring being spaced parallel above said body rim upper flange.

4. An improved banjo drumhead according to claim 1 wherein said tone ring lower surface has a plurality of spaced indentations for each support column, the upper end of each support column being received in said indentation.

5. An improved banjo drumhead according to claim 4 wherein the upper end of each of said support columns is pointed and wherein each of said indentation is circular with a V-shaped cross-sectional configuration.

6. An improved banjo drumhead according to claim 4 including a dampening pad positioned between each said support column upper end and said tone ring recess.

7. An improved banjo drumhead according to claim 1 wherein said tone ring has an outer circumferential surface having a larger diameter at the upper end and a smaller diameter at the lower end whereby the outer surface tapers in the direction towards said body rim; and including a clamp ring of internal diameter greater than the external diameter of said body rim and said tone ring, the clamp ring being slidably received on the outer diameter of said body rim and having said head membrane received between the clamp ring and body rim, the interior circumferential surface of said clamp ring being tapered opposite that of said tone ring outer circumferential surface whereby said two surfaces are parallel to and spaced from each other and having said head membrane therebetween; and means for clamping said clamp ring to said body rim.

8. An improved banjo drumhead according to claim 1 wherein said tone ring is of U-shaped configuration defined by an inner circumferential wall, an outer circumferential wall, a bottom in a plane parallel the plane of said body rim, and an open top providing a valley between the walls, the head membrane engaging the upper ends of said inner and outer walls, the bottom having spaced tonal quality improving openings therein.

9. An improved banjo drumhead according to claim 1 wherein said body rim includes an inwardly extending circumferential flange and wherein the lower end of each said support columns is affixed to said body circumferential flange.

* * * * *